United States Patent [19]

Harper

[11] 4,308,693

[45] Jan. 5, 1982

[54] BARREL-FINISHING APPARATUS

[75] Inventor: John F. Harper, Portland, Conn.

[73] Assignee: Harper Buffing Machine Co., East Hartford, Conn.

[21] Appl. No.: 13,630

[22] Filed: Feb. 21, 1979

[51] Int. Cl.[3] ..... B24B 31/02

[52] U.S. Cl. ..... 51/164.2

[58] Field of Search ..... 51/164 R, 164.2, 7; 366/219; 233/17, 25

[56] References Cited

U.S. PATENT DOCUMENTS 3,503,157 3/1970 Harper ..... 51/164.2

3,524,735 8/1970 Oitiker ..... 51/164.2

4,073,095 2/1978 Dieher ..... 51/164.2

FOREIGN PATENT DOCUMENTS 1405839 9/1975 United Kingdom ..... 51/164.2

*Primary Examiner*—Harold D. Whitehead

*Attorney, Agent, or Firm*—John B. Willard

[57] ABSTRACT

The barrels orbit to create a centrifugal force on the barrel contents while the barrels are concurrently rotating about internal axes counter to the orbital movement, utilizing endless members to impart both the orbital and counter rotating movement to a plurality of the barrels.

6 Claims, 4 Drawing Figures

BARREL-FINISHING APPARATUS

BACKGROUND OF THE INVENTION

The invention relates generally to barrel finishing machines and more particularly to machines in which the barrels are orbited and concurrently rotated. In accordance with the prior art the barrels are charged with an abrasive aggregate and work pieces, to be abraded by the aggregate.

The orbital movement subjects the contents to multi-gravity force and the concurrent barrel rotation shifts the contents while subject to the elevated force.

A sliding movement is effected between the work and the abrasive material which produces a sustained cutting or finishing action on the contours of the work without impact.

SUMMARY OF THE INVENTION

It is an object of the present invention to provide improvement in orbital barrel finishing machines.

In accordance with the invention, a plurality of the barrels are mounted or slung in an endless belt or chain member for both orbital and counter rotating movement. In a preferred embodiment of the invention, a single belt concurrently rotates and orbits the barrels while maintaining the orbital path and the rotation of the barrels.

In this embodiment, a pair of barrels are arranged with their individual axes spaced from each other and from a common axis about which they orbit. Preferably, the barrel axes may be arranged equidistant from each other or otherwise uniformly spaced about the common axis. The latter, preferably, may be central to the barrels. The barrels orbit about the common axis while the several barrels rotate about their own individual axes counter to their orbital movement.

It will be seen that a single endless belt restrains the barrels to orbital travel while rotating each barrel about an axis internal of the barrel while each barrel completes its orbit in the counter direction.

For a more specific understanding of the invention and so that it may be utilized readily, an embodiment will now be described more fully with reference to the accompanying drawings in which.

Figure 1:
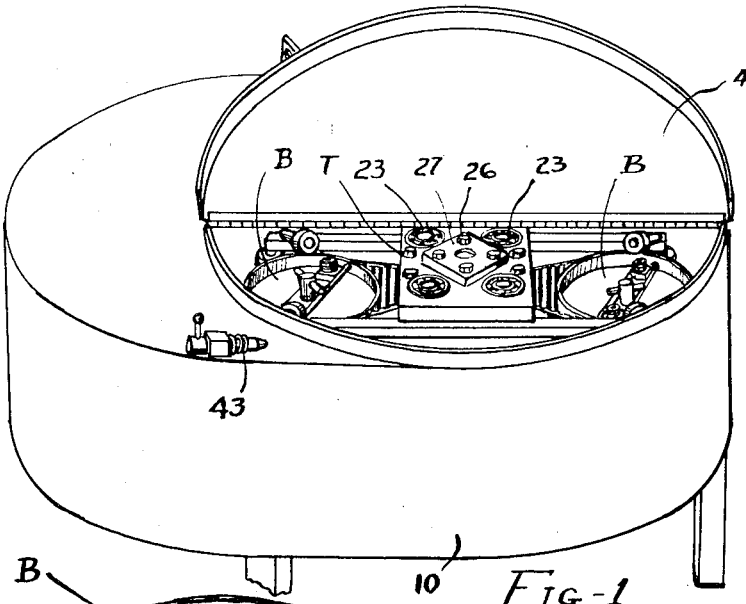
FIG. 1 is a perspective view of an apparatus in which work pieces are freely moved within abrasive media centrifugally compacted within barrels slung in a single endless belt or similar member for orbital and rotating movement in accordance with the invention.

Characteristic of the invention shown in the drawings, free work pieces W are pressed by centrifugal force within and by compacted abrasive particles P within a barrel B. The work pieces W are finished by the abrading or cutting action of the abrasive P as the latter slides over the edges and the surfaces of the work pieces W and the latter travel through the compacted abrasive P.

Figure 2:
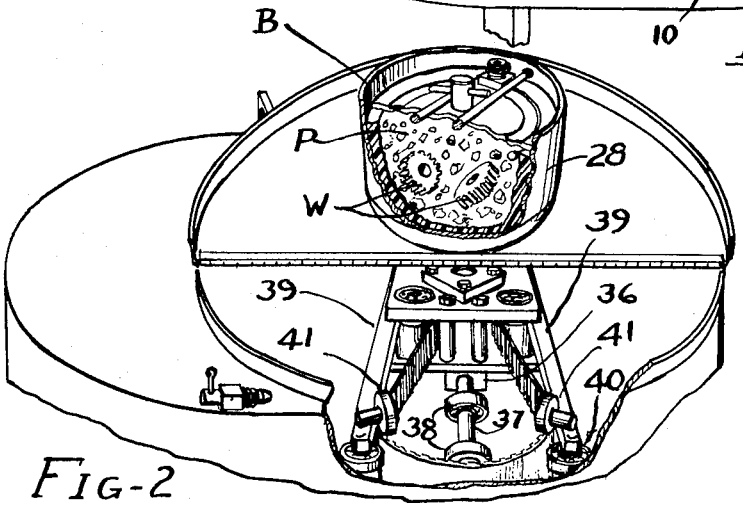
FIG. 2 is a view similar to FIG. 1 with the belt progressed to effect 90° of orbital movement and counter rotating barrel movement and with the barrel shown withdrawn from engagement with the belt.

Characteristic of the embodiment as shown in FIG. 2, the abrasive media P is compacted about a work piece W and the work piece moved through the compacted abrasive thereby finishing the edges and surfaces of the work piece.

Figure 3:
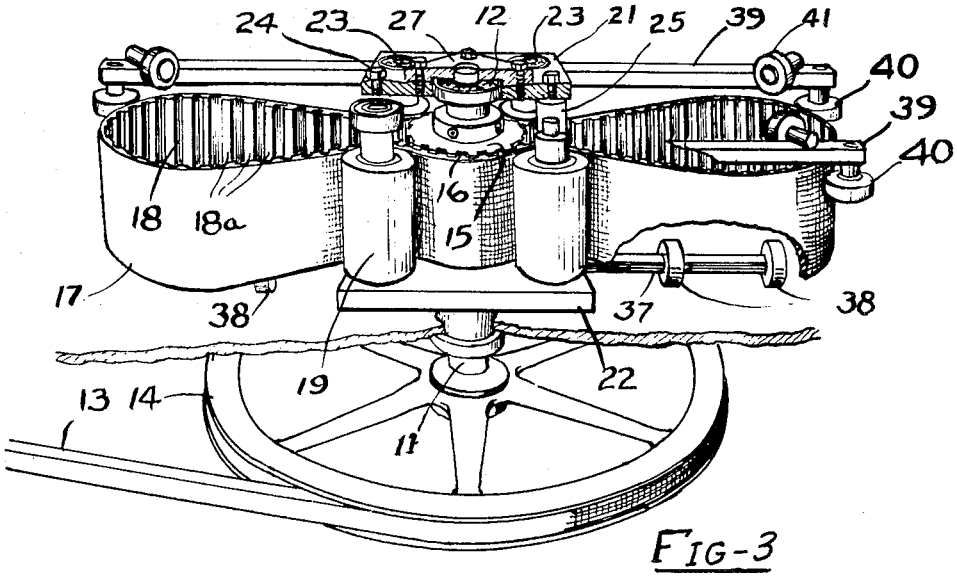
FIG. 3 is an enlarged view of the belt and belt drive shown in FIGS. 1 and 2.

Referring to FIGS. 1–3, a main frame structure generally designated 10 provides support for a vertical shaft 11 which is rotatably journalled in bearings 12, as shown in FIG. 3, for rotation by any suitable drive, the drive belt 13 and pulley 14 being illustrative.

Secured to the shaft 11 for rotation about a fixed pulley 15 is a drive turret generally designated T.

In the embodiment illustrated, the stationary drive pulley 15 has cogs 16 which engage conforming serrations or grooves 18 between ribs 18*a* of the inner surface of an endless belt 17.

As shown in FIGS. 1 and 3, the belt 17 is pressed by rollers 19 to hold grooves 18 of the belt 17 in interlocking engagement with the cogs 16 of the pulley 15.

Four of the rollers 19 equally spaced about the pulley 15 maintain two loops in the belt on diametrically opposite sides of the pulley 15 to removably receive the barrels B.

Each roller 19 is rotatably secured at its ends by bearings 23 mounted in a pair of spaced turret plates 21 and 22 each of which is keyed or otherwise secured to the turret drive shaft 11.

Preferably, for stability and strength the plates 21 and 22 are secured by cap screws 24 to spacers 25 so that the turret T, including its assembly of four pressing rollers 19, rotate as a unit about the stationary pulley 15.

Additional bolts 26 secure a cap plate 27 to the turret plate 21 and hold the bearings 23 for the rollers 19 positioned in the turret plate 21.

Each of the loops of the belt 17 removably receives a barrel B the outer cylindrical wall of which is securely slung in the belt loop when the drive belt 13 is actuated to rotate the turret T.

Each barrel B may be formed of a material having a high coefficient of friction or should be lined with such material.

Figure 4:
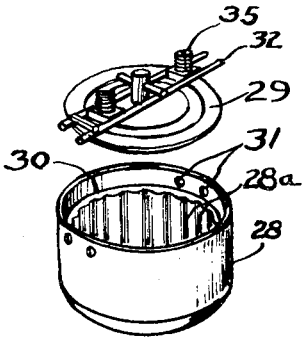
FIG. 4 is a view showing an individual barrel with cover removed.

Referring to FIG. 4, a removable barrel cover 29 fits snugly within each barrel B when the cover 29 is seated in the barrel lip or mouth 30.

A manually operable lock bar 32 releasably locks the cover 29 in the barrel.

As shown, the ends of the lock bar 32 are slidably receivable in pierced holes 31 in the barrel wall and are removably held therein by lock screws 35 threaded in the bar 32. The screws may be tightened into locking engagement with the cover 29 so that the lock bar 32 is held in locked engagement with the barrel B.

Secured to the underside of the turret plate 22 as by a block or holder 36 is a support rod 37 the outer end of which has rollers 38 which rollably supports the barrels B at the proper elevation in the loops of the belt 17.

Additional rods 39 project from the upper turret plate 21 and adjustably carry rollers 40 and 41 which engage the side and rim of the barrels B so that the barrels are guided and restrained in their proper positions during their orbital cycle. Safety switch 43 interrupts power to the drive belt 13 and pulley 14 whenever a cover 42 is opened and not engaging the switch 43.

Safety requires that the turret T and the orbiting barrels, together with the belts and sheaves, be guarded as by the guard and splash shield 10 and cover 42 which may be opened to load and unload the barrels B in the loops of the belt 17.

OPERATION

One or more work pieces W are placed loosely in each barrel B with abrasive P and the tops of the barrels sealed with the covers 29 by tightening the lock screws 35 of the lock bars 32.

In operation, the turret T is rotated to orbit the barrels B at a selected speed to effect a desired centrifugal force on the contents of the barrels. Merely as illustrated, a G-force, in a range from 5 to 25, has successfully deburred the edges and refined the surfaces of a multitude of metal and plastic articles.

Concurrently, the belt 17 is pressed by the turret rollers 19 against the fixed pulley 15 so that the belt 17 is advanced while maintaining the belt loops within which the barrels are centrifugally retained. The progressive advance of the belt 17 rotates the barrels about their individual axes counter to their orbital travel. Friction engagement is sufficient to effect rotation of the barrels B by the belt 17, although the outer surface of the barrels may be ribbed to mesh with the grooves 18 and ribs 18*a* of the belt for a more positive barrel rotation drive.

The belt 17 tightly holds and rotates the orbiting barrels and releases them when the turret is stopped for ready removal and reinstallation after the barrels are unloaded and recharged.

The greater the orbital speed the more positive the barrel rotation drive imparted by the belt 17.

The single belt drive automatically and inherently compensates for wear and belt stretch.

Preferably, the barrels 28 are made of rubber or other relatively soft material which has a high friction coefficient so that the inner surface 28*a* prevents sliding and imparts the smooth caterpillar tread movement to the abrasive media P characteristic of orbital barrel finishing.

A surface finishing machine constructed in accordance with this invention slings each barrel in a single loop of an endless belt or chain member. The single loop avoids the disadvantages experienced with a plurality of loops for slinging a barrel. Unequal length and stretch of plural loops is avoided.

While preferably a single belt slings a plurality of barrels in a plurality of loops, it is contemplated that a plurality of belts may be used. However, not more than one belt and one belt loop is used for each or any barrel.

As will be apparent to persons skilled in the art, various modifications and adaptations of the structure above described will become readily apparent without departure from the spirit and scope of the invention, the scope of which is defined in the appended claims.

I claim:

1. In a surface finishing machine of the type having a stationary frame and a rotary turret, a finishing barrel supported on the turret for orbital movement in one angular direction about a first axis to impart a first centrifugal force on contents of the barrel, the improvement comprising sling mounting means carried by the turret and engageable with the barrel for supporting the same for radial movement relative to the first axis, said sling mounting means including an endless continuous drive member having a loop in which the barrel is slung and limiting radial displacement of the barrel from a stationary starting position upon orbital movement thereof while causing the barrel to rotate continuously in the opposite angular direction sufficiently to impart a second force on contents thereof to modify the effect of the first centrifugal force and wherein said machine has a plurality of said barrels each of which is slung in an individual loop of said endless member.

2. The machine of claim 1 in which a plurality of said loops are formed in the endless member and an individual barrel is mounted in each loop.

3. The machine of claim 2 in which all of the loops for all of the barrels are formed in a single endless member.

4. The machine recited in claim 3 in which the turret rotates about a stationary drive member which engages and progresses the endless member counter to rotation of the turret about the drive member.

5. The machine of claim 4 in which a plurality of members on the turret maintain the loops in the endless member and said endless member in interlocking driven engagement with said drive member.

6. The machine of claim 5 in which roller members mounted on the turret engage and restrain the barrels at selected locations relative to the turret.

* * * * *